United States Patent [19]

Melbert

[11] Patent Number: 4,731,574

[45] Date of Patent: Mar. 15, 1988

[54] SERIES VOLTAGE REGULATOR WITH LIMITED CURRENT CONSUMPTION AT LOW INPUT VOLTAGES

[75] Inventor: Joachim G. Melbert, Steinhöring, Fed. Rep. of Germany

[73] Assignee: SGS-ATES Deutschland Halbleiter Bauelemente GmbH, Grafing, Fed. Rep. of Germany

[21] Appl. No.: 51,633

[22] Filed: May 20, 1987

Related U.S. Application Data

[63] Continuation of Ser. No. 669,737, Nov. 7, 1984, Pat. No. 4,704,572.

[30] Foreign Application Priority Data

Nov. 15, 1983 [DE] Fed. Rep. of Germany ..... 3341345

[51] Int. Cl.[4] ..... G05F 1/565

[52] U.S. Cl. ..... 323/275; 323/281; 323/282; 323/908; 361/18

[58] Field of Search ..... 323/275, 276, 277, 279, 323/281, 282, 299, 303, 908; 361/18, 86, 88

[56] References Cited

U.S. PATENT DOCUMENTS

| | | | |
|---|---|---|---|
| 3,025,451 | 3/1962 | Hakimoglu | 323/276 |
| 3,534,249 | 10/1970 | Neill et al. | 361/18 |
| 4,535,282 | 8/1985 | Nguyen | 323/276 |
| 4,608,529 | 8/1986 | Mallinson | 323/275 |
| 4,633,162 | 12/1986 | Melbert | 323/275 |

*Primary Examiner*—Patrick R. Salce
*Assistant Examiner*—Anita M. Ault
*Attorney, Agent, or Firm*—Spencer & Frank

[57] ABSTRACT

A series voltage regulator having a regulating transistor ($T_1$) arranged with its emitter-to-collector path in a series arm of the regulator, the base of which is controlled via a control transistor ($T_2$) by a first differential amplifier (V) which compares a reference voltage ($U_{REF}$) with a voltage proportional to the voltage ($U_2$) of the regulator output. A differential circuit ($V_2$) which compares the collector-to-emitter voltage of the regulating transistor ($T_1$) with an auxiliary voltage ($U_3$) is provided, the output of which is followed by a current limiting circuit ($T_3$) which acts upon control transistor ($T_2$). The auxiliary voltage ($U_3$) is larger than the collector-to-emitter voltage of the regulating transistor ($T_1$) which occurs at the beginning of the saturation state of the regulating transistor. The current limiting circuit ($T_3$) limits the current delivered by the control transistor ($T_2$) to the base of the regulating transistor ($T_1$) as soon as the differential circuit ($V_2$) detects a drop in the collector-to-emitter voltage of the regulating transistor ($T_1$) to the auxiliary voltage ($U_3$). The auxiliary voltage ($U_3$) may be controlled proportionally to the regulator output current.

21 Claims, 9 Drawing Figures

SERIES VOLTAGE REGULATOR WITH LIMITED CURRENT CONSUMPTION AT LOW INPUT VOLTAGES

This is a continuation of application Ser. No. 06/669,737 filed Nov. 7th, 1984 U.S. Pat. No. 4,704,572.

BACKGROUND OF THE INVENTION

The present invention relates to a series voltage regulator as in the introductory part of claim 1.

A conventional series voltage regulator of this type, as disclosed in U.S. patent specification No. 3,025,451 and shown in FIG. 1, is distinguished by a very low minimal series voltage drop. But as long as its input voltage is lower than that voltage level which is necessary for reaching the nominal voltage on the output side, this series voltage regulator loads with a high current the voltage source connected to its input, as shown in FIG. 2. The input current initially increases sharply in a starting range at an input voltage rising from zero, until that input voltage limit is reached at which the output voltage has reached the nominal value. In the normal operating range which is then reached, the current consumption on the input side of this series voltage regulator is many times smaller than the value which may be reached in the starting range.

Voltage sources, in particular batteries, which are designed with regard to current consumption in the normal operating range, are excessively strained in the case of undervoltage operation in the starting range. The high current consumption in the starting range may lead to these voltage sources being loaded to such a degree that the voltage they deliver does not reach the critical voltage level at which the transition to the normal operating range with normal current consumption is reached. The circuit arrangement consisting of this series voltage regulator and such a voltage source thus seizes in the starting range, resulting in a continuously high current consumption from the voltage source, i.e. rapid discharge of the battery, when a battery is being used as a voltage source.

SUMMARY OF THE INVENTION

The invention is based on the problem of improving a series voltage regulator of the described type in such a way as to prevent high current consumption in the starting range.

The solution to this problem is stated in claim 1 and may be advantageously designed in accordance with the further claims.

The invention is based on the finding that the control transistor of the known series voltage regulator, in the case of undervoltage on the input side, is driven by the the differential amplifier into the saturation state and thus to a maximal collector current limited only by the collector resistance, and that this maximal collector current, when flowing through the base-to-emitter diode of the regulating transistor, puts the regulating transistor in the saturation state.

The inventive remedy against the excessive current consumption of the series voltage regulator in the undervoltage range consists in detecting in good time the tendency of the regulating transistor to go into the saturation state and then, after detecting this tendency, to limit the current delivered by the control transistor to the base of the regulating transistor or decrease the reference voltage.

For this purpose, the collector-to-emitter voltage of the regulating transistor is compared by means of a differential circuit with an auxiliary voltage which is somewhat greater than the collector-to-emitter voltage of the regulating transistor at the beginning of the saturation state of this regulating transistor. As soon as the collector-to-emitter voltage has dropped to the value of the auxiliary voltage, the differential circuit, which is preferably a differential amplifier, acts on a limiting circuit in such a way that the current delivered by the control transistor to the base of the regulating transistor is limited, or the reference voltage at the reference voltage input of the first differential amplifier is decreased.

In a preferred embodiment, the former is effected by connecting in parallel to the base-to-emitter path of the control transistor, a limiting transistor whose base is connected to the output of the differential circuit. As soon as the collector-to-emitter voltage of the regulating transistor has dropped to the auxiliary voltage, the limiting transistor is switched on so that it removes base current from the control transistor, thereby preventing the control transistor from reaching a high collector current.

In a preferred embodiment in which the reference voltage is decreased, this is effected by connecting the limiting transistor in parallel to the reference voltage input of the first differential amplifier. As soon as the limiting transistor is switched on by the differential circuit, it decreases the reference voltage delivered to the reference voltage input of the first differential amplifier, so that the control transistor cannot reach a high collector current.

In a more simple embodiment of the inventive series voltage regulator, a constant voltage source is used as an auxiliary voltage source. Whenever the collector-to-emitter voltage has dropped to this constant voltage, the limiting of the collector current of the control transistor is carried out.

In an embodiment with constant auxiliary voltage, the auxiliary voltage source may be omitted between the emitter of the regulating transistor and the differential circuit when for the differential circuit an asymmetrical differential amplifier is used which does not switch on the limiting transistor only when the difference in the two input voltages of this differential amplifier unit reverses polarity signs, but as soon as this difference falls below a certain threshold. This threshold corresponds to the voltage level of the auxiliary voltage source.

The collector-to-emitter saturation voltage of a transistor is known to be dependent upon its collector current. Thus, the constant voltage of the auxiliary voltage source must be selected in such a way that the regulating transistor is reliably prevented from going into the saturation state at the maximal expected output current of the series voltage regulator. However, this means that, in the case of small collector currents of the regulating transistor and thus of small output currents of the series voltage regulator, current limitation is already applied when the collector-to-emitter voltage of the regulating transistor is still relatively far from its saturation voltage.

In order that the series voltage regulator can always be exploited, regardless of the particular output current, up to that limit at which the current increase to be avoided sets in, a particularly preferred embodiment of the inventive series voltage regulator is provided with an auxiliary voltage source whose voltage can be varied in accordance with the output current of the series voltage regulator. The variable voltage delivered by the auxiliary voltage source is preferably composed of a constant primary voltage level and a variable voltage superimposed on this primary voltage level and proportional to the output current of the regulator.

This is effected in a particularly preferred manner by forming the auxiliary voltage source by the voltage drop across a resistor which is acted upon, on the one hand, by the current of a constant current source and, on the other hand, by the current of a variable current source. The current delivered by the constant current source brings about the constant primary voltage level across this resistor, while the variable current source causes the variable voltage across this resistor.

In a first particularly preferred embodiment, the variable current source includes an auxiliary transistor whose emitter is connected to the emitter of the regulating transistor and whose base is connected to the base of the regulating transistor and whose collector yields a current proportional to the collector current of the regulating transistor, for which purpose the emitter area of the auxiliary transistor is put in a ratio to the emitter area of the regulating transistor which corresponds to the desired proportionality factor between the collector current of the regulating transistor and the collector current of the auxiliary transistor.

In a different, particularly preferred embodiment, a multitransistor with a main collector and an auxiliary collector is used as a regulating transistor, the auxiliary collector yielding a current proportional to the main collector current, for which purpose the auxiliary collector area is put in such a relation to the main collector area that the desired proportionality ratio arises between the auxiliary collector current and the main collector current.

The collector of the auxiliary transistor or the auxiliary collector is preferably connected to the input of a current mirror circuit, whose output is connected to the resistor constituting the auxiliary voltage source. In this manner, the variable current flowing through the resistor in the right direction, on the one hand, and there is a possibility of additionally influencing the proportionality factor between the collector current of the regulating transistor and the current causing the variable auxiliary voltage by designing the current mirror circuit accordingly, on the other hand.

The inventive series voltage regulator is preferably constructed with bipolar transistors, in order to attain a series voltage drop which is as small as possible, with a p-n-p power transistor as a regulating transistor for regulators with a positive output voltage. However, the series voltage regulator may also be constructed with an n-p-n regulating transistor, if the rest of the circuit is adapted accordingly.

It is also possible to use field-effect transistors, either for only some of the transistors,or for all transistors of the series voltage regulator with the exception of the power transistor in the series arm.

Furthermore, the inventive series voltage regulator is accommodated in a particularly preferred manner in one monolithically integrated circuit. This is where the invention is particularly significant due to the small current amplification of the power p-n-p transistors.

The invention thus provides a series voltage regulator whose regulating transistor is always operated in a working range in which its base current guarantees the necessary output current of the series voltage regulator but overloading leading to excessive current consumption is still avoided.

By aid of the inventive measures, series voltage regulators have been made available which, even in the starting, i.e. the undervoltage range, have a power consumption which is essentially predetermined by the load impedance.

The problem and solution of the invention, advantages of the invention and developments of the invention shall now be explained in more detail with reference to embodiments of series voltage regulators.

Fig . 3 is a circuit diagram illustrating a first embodiment of an inventive series voltage regulator of the present invention.

Figure 1:
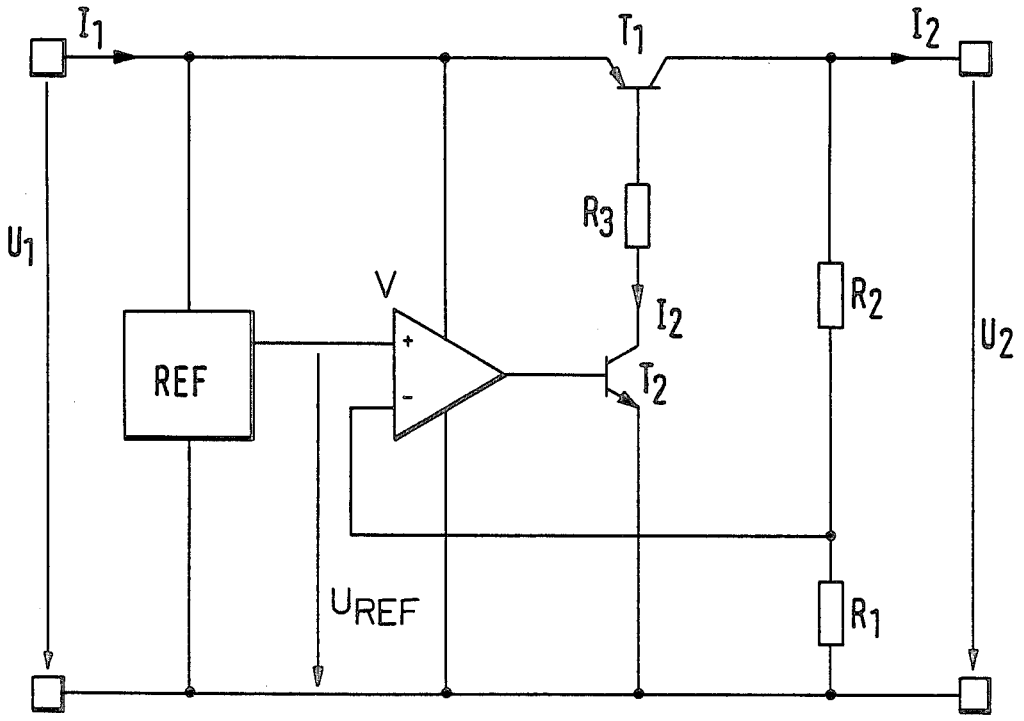
FIG.1 (PRIOR ART)
FIG. 1 is a circuit diagram of a conventional series voltage regulator.
Figure 3:
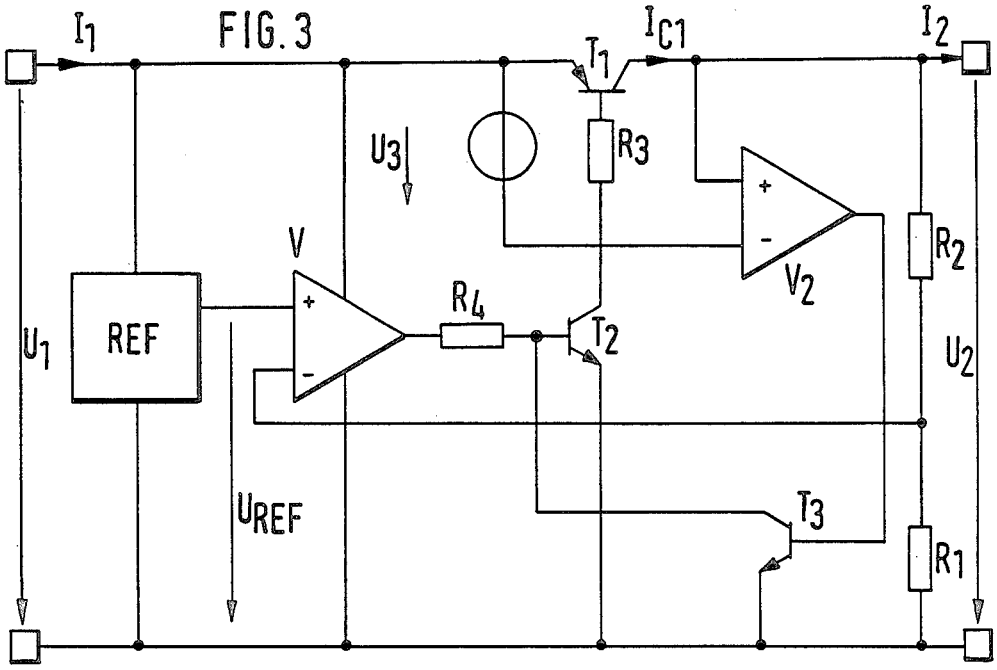
Figure 4:
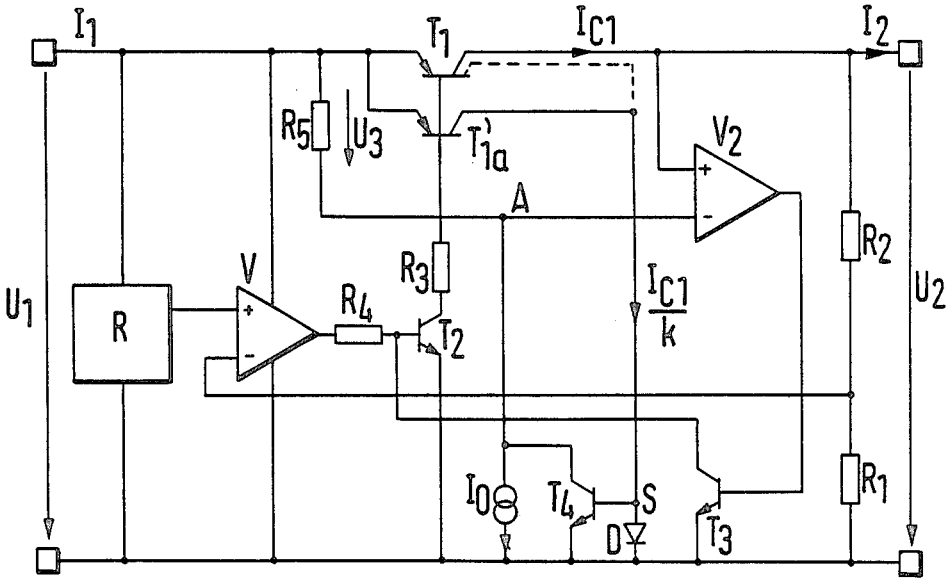
Figure 6A:
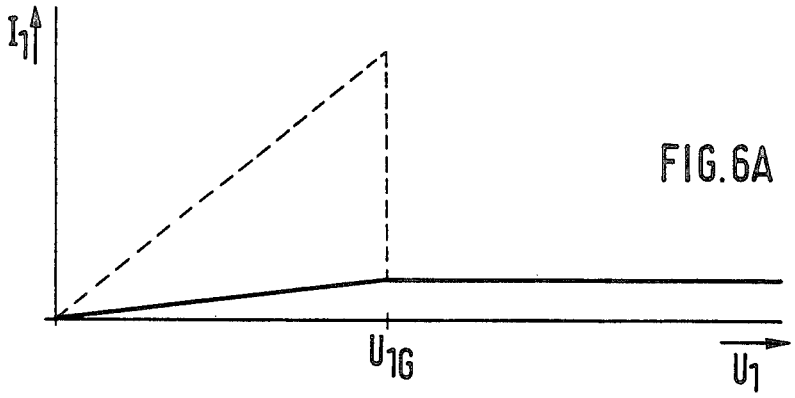
Figure 6B:
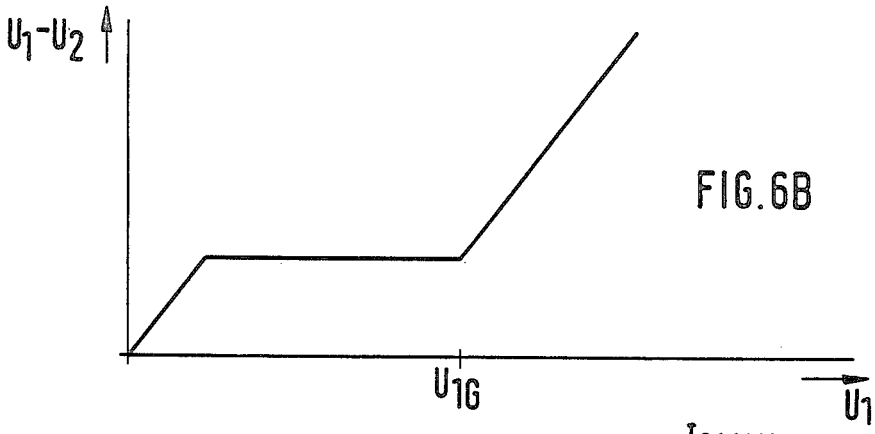
Figure 6C:
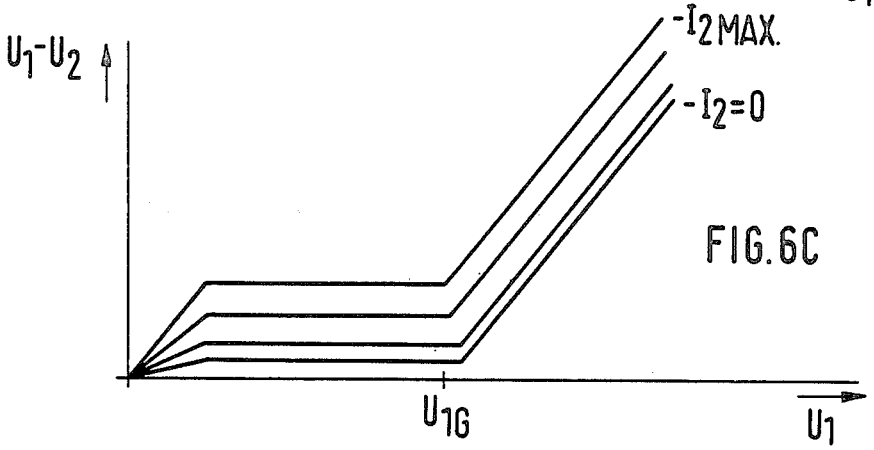
Figure 5:
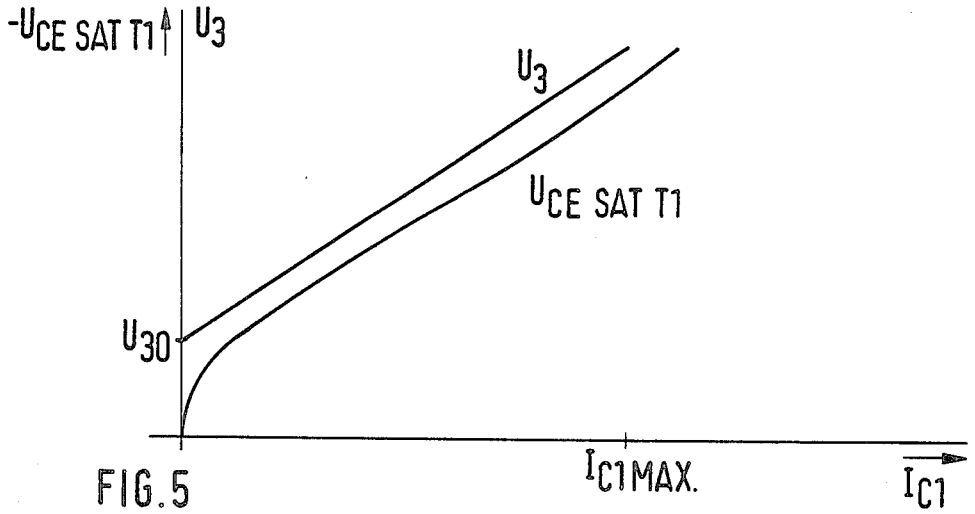
Figure 7:
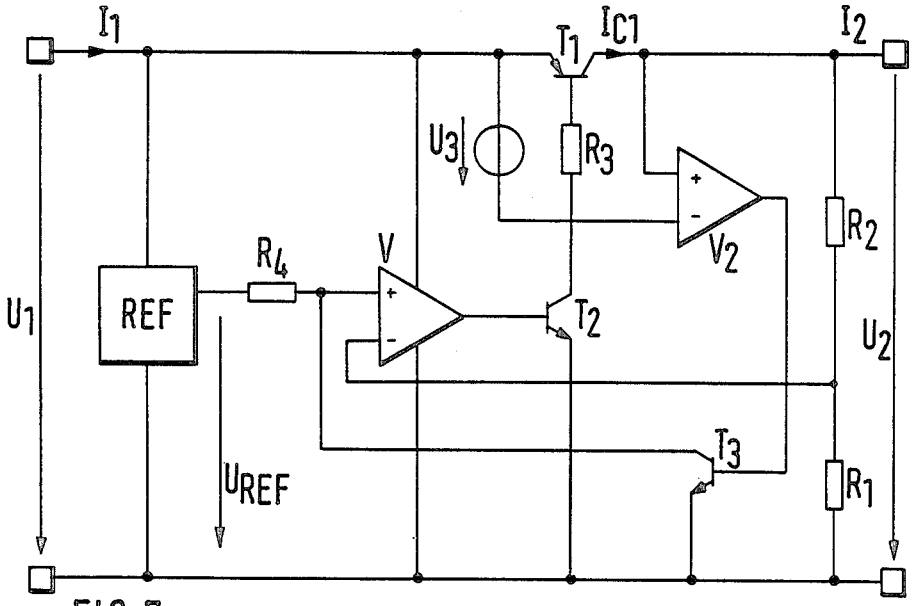

FIG. 4 is a circuit diagram illustrating a second embodiment of the series voltage regulator of the present invention;

FIG. 5 illustrates the collector-to-emitter saturation voltage as a function of the collector current and the auxiliary voltage varying as a function of the collector current of the regulating transistor in the embodiment as in FIG. 4;

FIG. 6 FIGS. 6A, 6B, and 6C illustrate working characteristics of the embodiments of series voltage regulators shown in FIGS. 1, 3 and 4; and FIG. 7 is a circuit diagram illustrating a third embodiment of the series voltage regulator of the present invention.

DESCRIPTION OF THE PREFERRED EMBODIMENTS

A conventional series voltage regualtor shall first be described with reference to FIG. 1. It includes the emitter-to-collector path of a regulating transistor $T_1$ arranged in common base configuration in one of the two series arms between the input connections and the output connections. Between the base and the other series arm, which is on the bottom in FIG. 1, the emitter-to-collector path of a control transistor $T_2$ is connected, whose base is connected to the output of a differential amplifier V. Between the collector of control transistor $T_2$ and the base of regulating transistor $T_1$ there is a limiting resistor $R_3$. A voltage divider with resistors $R_1$ and $R_2$ is connected in parallel to the output of the series voltage regulator. A reference voltage generator REF is connected in parallel to the input connections of the series voltage regulator, this generator delivering a constant reference voltage $U_{REF}$ to the noninverting input+of differential amplifier V. The inverting input−of differential amplifier V is connected to the connecting point between the two resistors $R_1$ and $R_2$ of the voltage divider. Differential amplifier V receives its supply voltage from the two series arm lines of the series voltage regulator which are connected to the input connections.

The input connections of the series voltage regulator are subjected to an input voltage $U_1$ the level of which may vary. A regulated voltage $U_2$ is obtained at the output of the series voltage regulator.

Such a voltage regulator advantageously has a very small minimal series voltage drop which is determined only by the saturation voltage of $T_1$.

In normal operation the nominal value $$U_2 = U_{2\,NOM} = \left(1 + \frac{R_2}{R_1}\right) U_{REF} \quad (1)$$

is obtained for the output voltage $U_2$.

This state is guaranteed for input voltages $U_1$ $$U_1 \geqq U_{2\,NOM} + U_{CE\,SAT\,T1} = U_{1G} \quad (2)$$

wherein $U_{CE\,SAT\,T1}$ is the collector-to-emitter saturation voltage of transistor $T_1$.

In this normal operation, a voltage drop equal to reference voltage $U_{REF}$ thus comes about across resistor $R_1$ of the voltage divider, so that a negligible differential voltage arises between the inputs of differential amplifier V. This keeps the base of control transistor $T_2$ at a constant voltage level. It is constantly assumed that the open circuit gain of the amplifier is infinitely large.

If input voltage $U_1$ falls below the critical value as in Equation (2), the voltage drop across resistor $R_1$ of the voltage divider can no longer reach the level of reference voltage $U_{REF}$. Due to the differential voltage resulting between the inputs of the differential amplifier V and the usually very high amplification of such a differential amplifier, control transistor $T_2$ is driven into the maximally conductive state. The collector current of control transistor $T_2$ flowing across the emitter-to-base diode of regulating transistor $T_1$ is then limited solely by the limiting resistor $R_3$. The following holds in this state:

$$I_{C\,T2} = (U_1 - |U_{BE\,T1}| - / |U_{CE\,SAT\,T2}|)/R_3. \quad (3)$$

The maximal collector current of $T_2$ must be dimensioned in such a way that the maximal output current of the series voltage regulator is made possible which is required by the load connected to the series voltage regulator.

P-n-p power transistors are preferably used for such series voltage regulators in order to allow for a series voltage drop which is as low as possible. Such p-n-p power transistors, however, only have relatively low current amplification $$B_{PNP} \approx 3 \ldots 10 \quad (4)$$

in the range of maximal output current. Control transistor $T_2$ must therefore be able to deliver a correspondingly large drive current to the base of regulating transistor $T_1$. Limiting resistor $R_3$ must therefore be selected so as to be correspondingly small.

This means that the drive current may be up to 50% of the maximal output current $I_2$ of the series voltage regulator in the starting range, i.e. in the undervoltage range, in which the input voltage $U_1$ is lower than critical value $U_{1G}$ according to Equation (2), without the series voltage regulator being loaded at the output.

Figure 2:
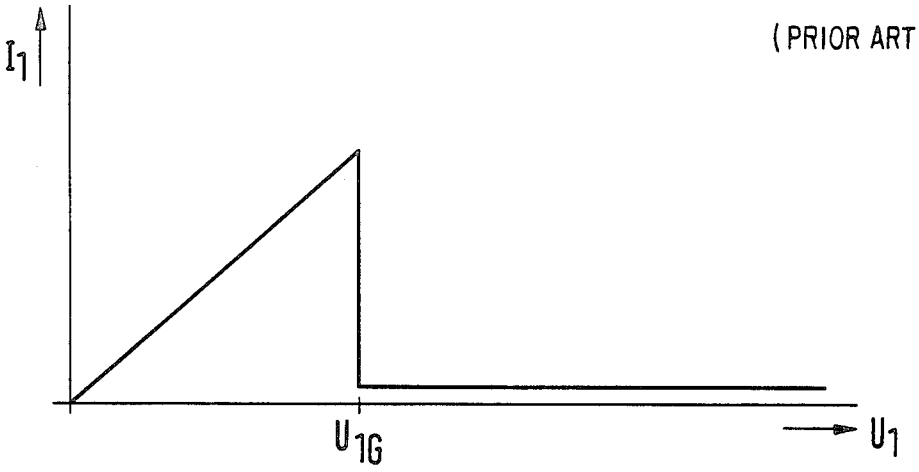
FIG. 2 illustrates current behavior of this conventional series voltage regulator.

FIG. 2, which shows input current $I_1$ of the series voltage regulator as a function of input voltage $U_1$, illustrates this starting current for a case of operation with a small load current. In the starting range, starting current $I_1$ increases very sharply and then, when reaching critical value $U_{1G}$, passes into the normal operating level at which output voltage $U_2$ assumes its nominal value $U_{2\,NOM}$ and input current $I_1$ remains at a fairly low constant level.

A first embodiment of an inventive series voltage regulator which does not have this high starting current is shown in FIG. 3. This series voltage regulator includes, in addition to the circuit means shown in FIG. 1, an auxiliary voltage source $U_3$, a second differential amplifier $V_2$ acting as a differential circuit, a limiting transistor $T_3$ and a second limiting resistor $R_4$. The non-inverting input+of the second differential amplifier $V_2$ is connected to the collector of regulating transistor $T_1$. The inverting input—of the second differential amplifier $V_2$ is connected to the emitter of regulating transistor $T_1$ via auxiliary voltage source $U_3$. Limiting transistor $T_3$ is connected with its emitter-to-collector path in parallel to the emitter-to-base path of control transistor $T_2$. The base of limiting transistor $T_3$ is connected to the output of the second differential amplifier $V_2$. The second limiting resistor $R_4$ is connected between the output of the first differential amplifier V and the base of control transistor $T_2$. Transistors $T_2$ and $T_3$ are n-p-n transistors in this embodiment.

Auxiliary voltage source $U_3$ delivers a constant voltage which is somewhat greater than the collector-to-emitter saturation voltage of regulating transistor $T_1$ at the maximal required output current $I_2$ of the series voltage regulator.

The disadvantage of the conventional series voltage regulator as in FIG. 1, that the input voltage source is loaded in the starting range with a high starting current, is overcome by the additional circuit means as in FIG. 3 on the basis of the mode of functioning described in the following.

When the collector-to-emitter voltage of regulating transistor $T_1$ is higher than auxiliary voltage $U_3$, the output of the second differential amplifier $V_2$ keeps limiting transistor $T_3$ blocked so that its parallel connection to the base-to-emitter path of control transistor $T_2$ does not have any effect. When the collector-to-emitter voltage of $T_1$ falls below auxiliary voltage $U_3$, i.e. when $$u_{CE\,T1} < U_3, \quad (5)$$

the output of the second differential amplifier $V_2$ assumes a potential which switches limiting transistor $T_3$ into the conductive state. At least part of the current delivered by the output of the first differential amplifier V then flows off via limiting transistor $T_3$. Consequently, the base current of control transistor $T_2$ is limited, which in turn leads to a limitation of the collector current of the control transistor and thus to a limitation of the current consumption of the series voltage regulator.

In the starting range in which the differential amplifier V would put the control transistor $T_2$ and the regulating transistor $T_1$ into the saturation state in the conventional series voltage regulator, the second differential amplifier $V_2$ assumes the leading function in the inventive series voltage regulator for usefully limiting the current delivered by control transistor $T_2$ and thus the current removed from the input voltage source.

The collector-to-emitter saturation voltage $U_{CE\,SAT\,T1}$ of regulating transistor $T_1$ depends on the intensity of the collector current $I_{C1}$ of regulating transistor $T_1$, as shown in the lower curve of FIG. 5. The auxiliary voltage $U_3$ should, in the series voltage regulator as in FIG. 3, be such that $$U_{CE\,SAT\,T_1}(I_{C1\,MAX}) < U_3 \quad (6)$$

at the maximal load current $I_{2\,MAX}$ of the series voltage regulator. This guarantees that the limitation of the collector current of control transistor $T_2$ is performed in good time even in the case of maximal output current.

There is a restriction in the embodiment as in FIG. 3 due to the fact that the minimal series voltage drop across the collector-to-emitter path of regulating transistor $T_1$ is fixed at constant auxiliary voltage $U_3$, although lower series voltage drops than $U_3$ would be allowable in the case of smaller load currents $I_2$ without any undesirable current over-loading taking place.

This is remedied by the embodiment of the invention shown in FIG. 4. In this embodiment auxiliary voltage $U_3$ is controlled as a function of output current $I_2$. $U_3$ is a function of the collector-to-emitter saturation voltage curve of $T_1$, as shown in FIG. 5.

This is effected by replacing constant voltage source $U_3$ in FIG. 3 by a resistor $R_5$ which is connected at one end to the emitter of regulating transistor $T_1$ and at the other end to the inverting input of differential amplifier $V_2$. A constant current source $I_O$ is connected to connecting point A between resistor $R_5$ and the inverting input of second differential amplifier $V_2$, the current of this current source causing across resistor $R_5$ a constant voltage drop which forms a constant primary portion $U_{30}$ of variable auxiliary voltage $U_3$. Further, the output side of a current mirror circuit with a transistor $T_4$ and a diode D is connected to connecting point A, the input of this circuit being connected to the collector of an auxiliary transistor $T_1'$ or to an auxiliary collector of a regulating transistor $T_1$ designed as a multi-transistor (shown by dotted lines in FIG. 4). In the variant with auxiliary transistor $T_1'$, the latter is designed, like regulating transistor $T_1$, as a p-n-p transistor and its base is connected to the base of regulating transistor $T_1$ and its emitter to the emitter of regulating transistor $T_1$.

The collector-to-emitter path of transistor $T_4$ belonging to the current mirror circuit, this transistor being an n-p-n transistor, is connected in parallel to constant current source $I_O$. The anode of diode D is connected to a connecting point S between the collector of auxiliary transistor $T_1'$ or the auxiliary transistor of multi-transistor $T_1$ and the base of transistor $T_4$. The cathode of diode D is connected to the lower series arm of the series voltage regulator, to which the lower end of constant current source $I_O$ and the emitters of transistors $T_3$ and $T_4$ are also connected.

The collector of auxiliary transistor $T_1'$ or the auxiliary collector of multi-transistor $T_1$ delivers an auxiliary collector current $I_{C1}/k$, which is proportional to the main collector current of regulating transistor $T_1$. When auxiliary transistor $T_1'$ is used, an emitter area which is 1/k times as large as the emitter area of regulating transistor $T_1$ is selected for this auxiliary transistor $T_1'$. When a multi-transistor $T_1$ is used, a collector area division of k:1 is selected for the main collector and the auxiliary collector. On the condition that the current delivered by the output of the current mirror circuit is of the same magnitude as the current delivered to the input of the current mirror circuit, the variable current source delivers to resistor $R_5$ a portion of current $I_{C1}/k$ which is superimposed on constant current $I_O$. Thus, a variable auxiliary voltage $$U_3 = U_{30} + U_{3\,V} = R_5(I_O + I_{C1}/k) \quad (7)$$

is obtained. $U_{30}$ is the constant portion and $U_{3\,V}$ the variable portion of auxiliary voltage $U_3$.

The current mirror circuit effects a reversal of the direction of the current delivered by the collector of auxiliary transistor $T_1'$ or by the auxiliary collector of multi-transistor $T_1$. Using the current mirror circuit, one may also, if desired, influence the proportionality factor between the collector current of control transistor $T_1$ and the current delivered to resistor $R_5$ by the current mirror circuit. By using the method used in the embodiment as in FIG. 4 of controlling the series voltage drop of the voltage regulator as a function of its output current, one achieves minimum current consumption and a minimum voltage drop at the same time. This is shown by comparison of the characteristics shown in FIG. 6.

FIGS. 6*a* shows current consumption $I_1$ of the series voltage regulator as a function of input voltage $U_1$, in dotted lines for the conventional series voltage regulator as in FIG. 1, and in a continuous line for the inventive series voltage regulator as in FIGS. 3 and 4. It is apparent that the inventive series voltage regulators no longer show the high starting current as in the conventional regulator.

FIG. 6*b* shows the difference between the input voltage $U_1$ and output current $U_2$, i.e. the series voltage drop, of the series voltage regulator with constant auxiliary current source $U_3$ as shown in FIG. 3.

FIG. 6*c* shows the series voltage drop $U_1 - U_2$ as a function of input voltage $U_1$ for the embodiment with variable auxiliary voltage $U_3$ as in FIG. 5. The adaptation of auxiliary voltage $U_3$ to the particular output current of the series voltage regulator leads to a corresponding adaptation of the series voltage drop as shown by the various characteristics in FIG. 6*c*, which hold for output currents $I_2$ of varying magnitude of the series voltage regulator. In the case of maximum output current $I_{2\,MAX}$ the same series voltage drop curve is obtained as in FIG. 6*b*. In the case of lower output currents, between $I_{2\,MAX}$ and $I_2=0$, lower series voltage drops are obtained.

Even when the series voltage regulator as in FIG. 4 is used for different loads involving different maximal current requirements it always works with a minimal series voltage drop.

If one decides to use the series voltage regulator with the more simple construction as in FIG. 3, on the other hand, it is advisable to dimension the series voltage regulator differently with regard to the constant voltage level of auxiliary voltage source $U_3$, in accordance with the maximal current requirement of the consumer to be supplied in each particular case.

A further embodiment of the invention is shown in FIG. 7. It corresponds to a large extent to the embodiment shown in FIG. 3, and also exhibits the references used therein. Unlike the embodiment as in FIG. 3, the second limiting resistor $R_4$ is not connected between the output of the first differential amplifier V and the base of control transistor $T_2$ in the embodiment shown in FIG. 7, but between the output of reference voltage source REF and the non-inverting input of first differential amplifier V which constitutes the reference voltage input. Further, the collector of limiting transistor $T_3$ is not connected to the base of control transistor $T_2$ but to the reference voltage input + of first differential amplifier V.

As regards that circuit part in which FIG. 3 and 7 are identical with each other, the embodiment as in FIG. 7 may be designed as in FIG. 4, i.e. it may have an auxiliary voltage source controlled by load current in either of the embodiments shown in FIG. 4.

The difference between the embodiment as in FIG. 7 and the embodiment shown in FIG. 3 leads to the following functional change.

As soon as it is detected by aid of second differential amplifier $V_2$ that regulating transistor $T_1$ is about to go into the saturation state, the reference voltage occurring at the reference voltage input + of first differential amplifier V is decreased by switching limiting transistor $T_3$ into the conductive state. As soon as the input circuit assumes such a voltage level, for example during the switching-on process, that the collector-to-emitter voltage of regulating transistor $T_1$ can assume a level higher than auxiliary voltage $U_3$, second differential amplifier $V_2$ switches off limiting transistor $T_3$ so that the full reference voltage can take effect again at the input of first differential amplifier V and the output voltage $U_2$ can be regulated to the actual nominal voltage.

What I claim is:

1. A series voltage regulator comprising a normally non-saturated regulating transistor with its emitter-to-collector path arranged in a series arm of the regulator, the base of said regulating transistor being controlled via a control transistor by a first differential amplifier having first and second input ports, the first differential amplifier comparing a reference voltage which is supplied to the first input port with a voltage which is supplied to the second input port and which is proportional to the output voltage of the regulator, wherein the reference voltage supplied to the first input port of the first differential amplifier is controlled as a function of the difference between the input voltage and the output voltage of the series voltage regulator.

2. The series voltage regulator as in claim 1, wherein a differential circuit is provided which compares the collector-to-emitter voltage of the regulating transistor with an auxiliary voltage, the output of said differential circuit being followed by a limiting circuit which is connected to the first input port of the first differential amplifier, the auxiliary voltage being greater than the collector-to-emitter voltage of the regulating transistor which comes about at the beginning of the saturation state of the regulating transistor, and the limiting circuit decreasing a voltage delivered by a reference voltage source to the first input port of the first differential amplifier as soon as the differential circuit detects a decrease in the collector-to-emitter voltage of the regulating transistor to the auxiliary voltage.

3. The series voltage regulator as in claim 2, wherein the differential circuit includes a second differential amplifier, whose non-inverting input is connected with the collector of the regulating transistor and whose inverting input is connected to the emitter of the regulating transistor via an auxiliary voltage source which delivers the auxiliary voltage.

4. The series voltage regulator as in claim 2, wherein the limiting circuit includes a limiting transistor whose emitter-to-collector path is connected between the first input port of the first differential amplifier and the series arm of the series voltage regulator not provided with the regulating transistor and whose base is connected to the output of the differential circuit.

5. The series voltage regulator as in claim 2, wherein the base of the control transistor is connected to the output of the first differential amplifier, whose first input port is connected to the reference voltage source and whose seond input port is connected to a tapping point of a voltage divider connected in parallel to the output of the series voltage regulator.

6. The series voltage regulator as in claim 2, wherein the auxiliary voltage is formed by a constant voltage source.

7. The series voltage regulator as in claim 2, wherein the auxiliary voltage may be varied in accordance with the output current of the series voltage regulator.

8. The series voltage regulator as in claim 7, wherein the auxiliary voltage is composed of a constant primary voltage and a variable voltage superimposed on this primary voltage and proportional to the output current of the regulator.

9. The series voltage regulator as in claim 8, wherein the differential circuit includes a second differential amplifier, wherein the auxiliary voltage is delivered by an auxiliary voltage source which includes a resistor connected between the emitter of the regulating transistor and the inverting input of the second differential amplifier and wherein the connecting point between the resistor and the inverting input of the second differential amplifier is connected both to a constant current source generating the primary voltage and to a variable current source generating the variable voltage and whose current is proportional to the collector current of the regulating transistor.

10. The series voltage regulator as in claim 9, wherein the variable current source includes an auxiliary transistor whose emitter is connected to the emitter of the regulating transistor and whose base is connected to the base of the regulating transistor and whose collector yields a current proportional to the collector current of the regulating transistor, the emitter area of the auxiliary transistor and the emitter area of the regulating transistor being in a relation corresponding to the desired proportionality factor between their collector currents.

11. The series voltage regulator as in claim 10, wherein the collector of the auxiliary transistor is connected to the input side of a current mirror, whose output side is connected to the connecting point between the resistor and the inverting input of the second differential amplifier.

12. The series voltage regulator as in claim 11, wherein the collector of the auxiliary transistor is connected to the base of a transistor with its emitter-to-collector path connected in parallel to the constant current source, a diode being connected in parallel to its base-to-emitter path.

13. The series voltage regulator as in claim 9, wherein the regulating transistor is designed as a multi-transistor having a main collector connected to the output of the series voltage regulator, and an auxiliary collector yielding a current proportional to the main collector current, the main collector area and the auxiliary collector area being in a relation corresponding to the desired proportionality ratio between the main and auxiliary collector currents.

14. The series voltage regulator as in claim 13, wherein the auxiliary collector is connected to the input side of a current mirror, whose output side is connected to the connecting point between the resistor and the inverting input of the second differential amplifier.

15. The series voltage regulator as in claim 14, wherein the auxiliary collector is connected to the base of a transistor with its emitter-to-collector path connected in parallel to the constant current source, a diode being connected in parallel to its base-to-emitter path.

16. The series voltage regulator as in claim 9, wherein the variable current source includes an auxiliary transistor whose emitter is connected to the emitter of the regulating transistor and whose base is connected to the base of the regulating transistor and whose collector yields a current proportional to the collector current of the regulating transistor, the emitter area of the auxiliary transistor and the emitter area of the regulating transistor being in a relation corresponding to the desired proportionality factor between their collector currents, and wherein the collector of the auxiliary transistor is connected to the base of a transistor with its emitter-to-collector path connected in parallel to the constant current source, a diode being connected in parallel to its base-to-emitter path.

17. The series voltage regulator as in claim 16, wherein for at least some of the transistors, field-effect transistors are provided whose source, drain and gate electrodes replace the emitter, collector and base electrodes.

18. The series voltage regulator as in claim 9, wherein the regulating transistor is designed as a multi-transistor having a main collector connected to the output of the series voltage regulator, and an auxiliary collector yielding a current proportional to the main collector current, the main collector area and the auxiliary collector area being in a relation corresponding to the desired proportionality ratio between the main and auxiliary collector currents, and wherein the auxiliary collector is connected to the base of a transistor with its emitter-to-collector path connected in parallel to the constant current source, a diode being connected in parallel to its base-to-emitter path.

19. The series voltage regulator as in claim 18, wherein for at least some of the transistors, field-effect transistors are provided whose source, drain and gate electrodes replace the emitter, collector and base electrodes.

20. A series voltage regulator for transferring electric power from a battery to a load, comprising a normally non-saturated regulating transistor with its emitter-to-collector path arranged in a series arm of the regulator, the base of said regulating transistor being controlled via a control transistor by a first differential amplifier having first and second input ports, the first differential amplifier comparing a reference voltage which is supplied to the first input port with a voltage which is supplied to the second input port and which is proportional to the output voltage of the regulator, wherein the reference voltage supplied to the first input port of the first differential amplifier is controlled as a function of the difference between the input voltage and the output voltage of the series voltage regulator.

21. A series voltage regulator having first and second input ports for receiving electrical power from a power source and having first and second output ports for providing regulated electrical power to a load, comprising:

a regulating transistor, the emitter-to-collector path of the regulating transistor being connected between the first input port of the regulator and the first output port of the regulator;

voltage divider means, connected between the first and second output ports of the regulator, for generating a signal that is proportional to the voltage between the first and second output ports;

a differential amplifier having first and second input ports and having an output port, the second input port of the differential amplifier receiving the signal that is proportional to the voltage between the first and second output ports of the regulator;

a control transistor, the emitter-to-collector path of the control transistor being connected between the base of the regulating transistor and the second output port of the regulator, the base of the control transistor being connected to the output port of the differential amplifier;

a reference voltage source;

an impedance element connected between the reference voltage source and the first input port of the differential amplifier;

means connected to the first input port of the differential amplifier for controlling the potential at the first input port of the differential amplifier as a function of the voltage between the collector and emitter of the regulator transistor; and means for connecting the second input port of the regulator to the second output port of the regulator.

* * * * *